US005282481A

United States Patent [19]

Ziemer

[11] Patent Number: 5,282,481

[45] Date of Patent: Feb. 1, 1994

[54] SHOCKING DEVICE FOR PERSONAL PROTECTION

[76] Inventor: Steven G. Ziemer, 311 22nd Ave. No., St. Cloud, Minn. 56303

[21] Appl. No.: 848,698

[22] Filed: Mar. 9, 1992

[51] Int. Cl.[5] ..... F41B 15/04

[52] U.S. Cl. ..... 607/145; 361/232

[58] Field of Search ..... 128/419 R, 783, 796, 128/797, 800, 801; 361/232

[56] References Cited

U.S. PATENT DOCUMENTS

| | | | |
|---|---|---|---|
| 1,915,721 | 6/1933 | Diaz | 361/232 |
| 4,167,036 | 9/1979 | Kenney | 363/61 |
| 4,242,715 | 12/1980 | Laird | 361/232 |
| 4,510,939 | 4/1985 | Brenman et al. | 128/800 |
| 4,667,431 | 5/1987 | Meudicino | 361/232 |

*Primary Examiner*—William E. Kamm
*Assistant Examiner*—George Manuel
*Attorney, Agent, or Firm*—John P. Halvonik

[57] ABSTRACT

A hand-held electrical shocking device for personal defense that is attached to the upper portion of the fist or hand and shocks an attacker when the fist and device are contacted against the attacker. The device has a central portion in resilient connection with a contacting means that is held away from it. Contacting points on both portions complete an electrical circuit which energizes shock probes located on the outside edge of the device. The contacting portion overhangs the knuckles when attached so that it will make contact with an attacker when the device is driven against the person of the attacker. As the contacting piece makes contact with the attacker, it is pushed back against a contact point(s) on the central portion and an electrical connection is established that delivers the shock through the shock probes.

3 Claims, 3 Drawing Sheets

FIG. 5
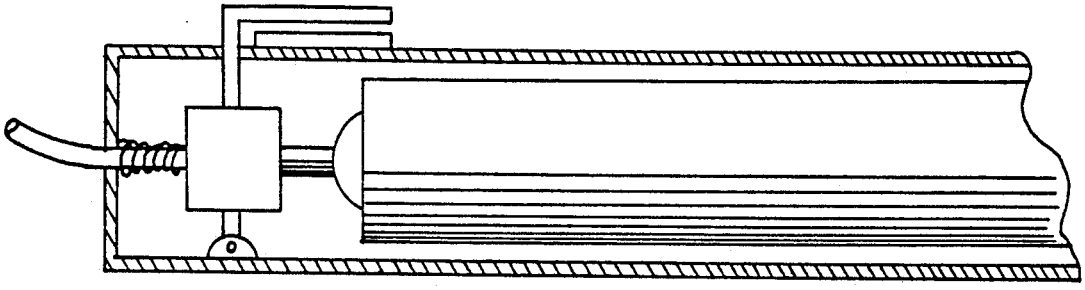
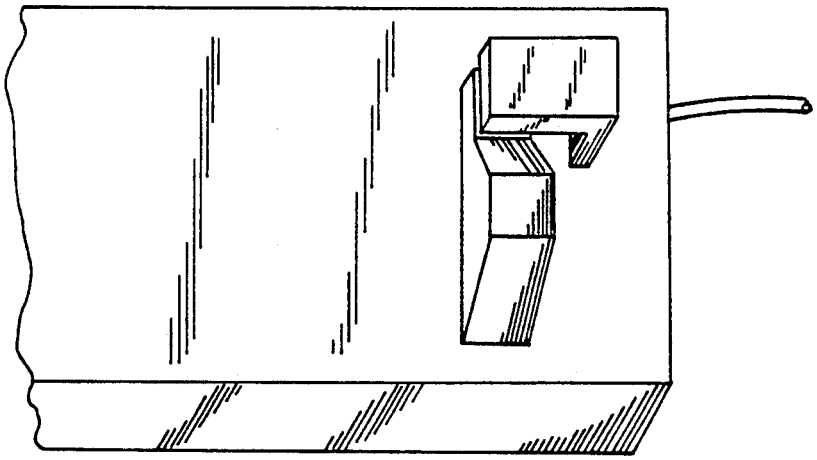
FIG. 6

SHOCKING DEVICE FOR PERSONAL PROTECTION

BACKGROUND

1. Field of the Invention

The invention relates to the field of personal defense devices and, in particular, to an electrical shocking device that is attached to the upper portion of the fist and delivers an electric shock upon making contact with an attacker.

2. Prior Art

While shocking devices are known, like electric rods and buzzers that attach to the palm, none that applicant is aware of are attached at the top of the fist. Nor do any use a spring-biased, contacting portion, as the energization step for delivering an electric current to the attacker.

SUMMARY OF THE INVENTION

The invention comprises a shock-producing unit attached to the fist and a power source attached to the forearm for supplying electrical power to the shock probes at the sides of the unit. The working portions of the unit comprise a central section which contains at least two electrical leads. Completing a circuit across the leads energizes the power converter device located on the forearm and the power converter in turn energizes the shockprobes that deliver the actual shock.

One of the contact points is connected to one of the leads and is attached to the central portion. A second contact point is located on the contacting piece and is connected to the other lead. The contacting portion is held in spring biased position away from the central portion. The contact point on the contacting portion makes contact with the contacting point on the central portion when the contacting portion is pressed against an attacker. With the connection closed, the circuit is closed, the power converter is energized and the shock probes provide a shock to deter attackers. The power source may be attached to the forearm. The unit comes with an optional mace dispensing device.

An objective of the invention is to provide a shocking device for defense that can be worn without accidentally discharging.

Another objective of the invention is to provide a shocking device for delivering a shock to attackers only upon making contact with a contacting portion of the device.

Another objective is to design a shocking device which will always immediately available for use with resort to a pocket, purse, etc.

Yet another objective is to provide a shocking device which cannot be taken away from the user as it is connected directly to the hand or fist.

Still another objective is to design a shocking device which keeps both hands free for use in defending oneself.

Still another objective is to provide a shocking device for self-defense which can be easily concealed.

Other objectives of the invention will become apparent once the invention is shown and described.

DESCRIPTION OF THE PREFERRED EMBODIMENT

Figure 1:
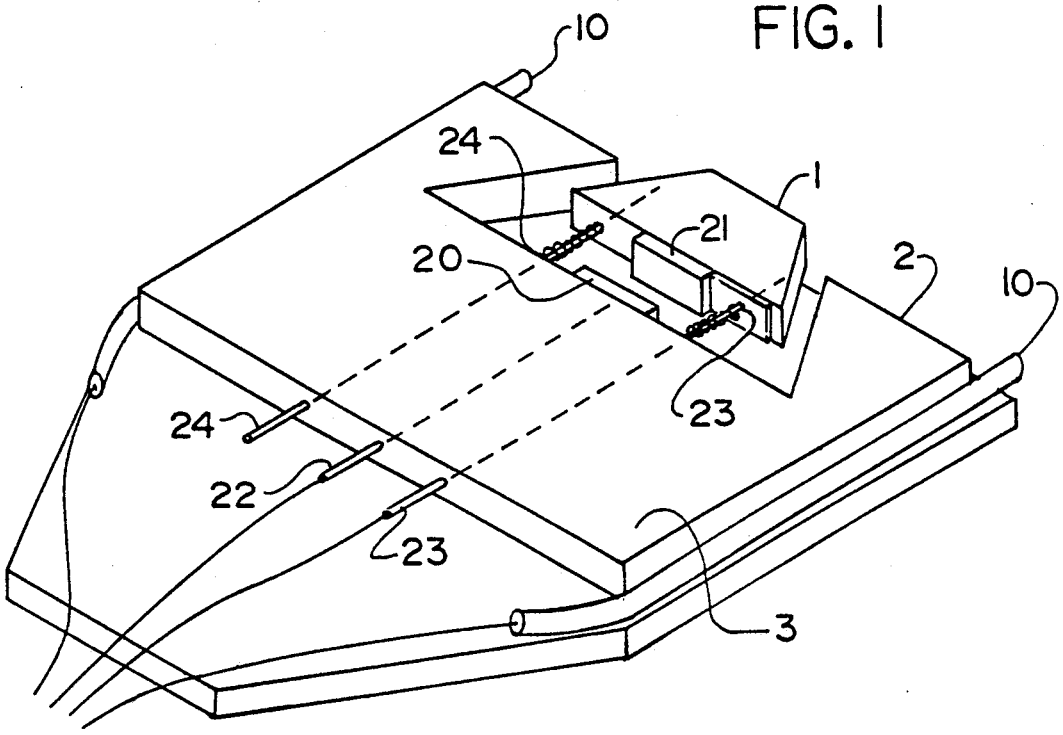
FIG. 1 shows the overall construction of the device.
Figure 2:
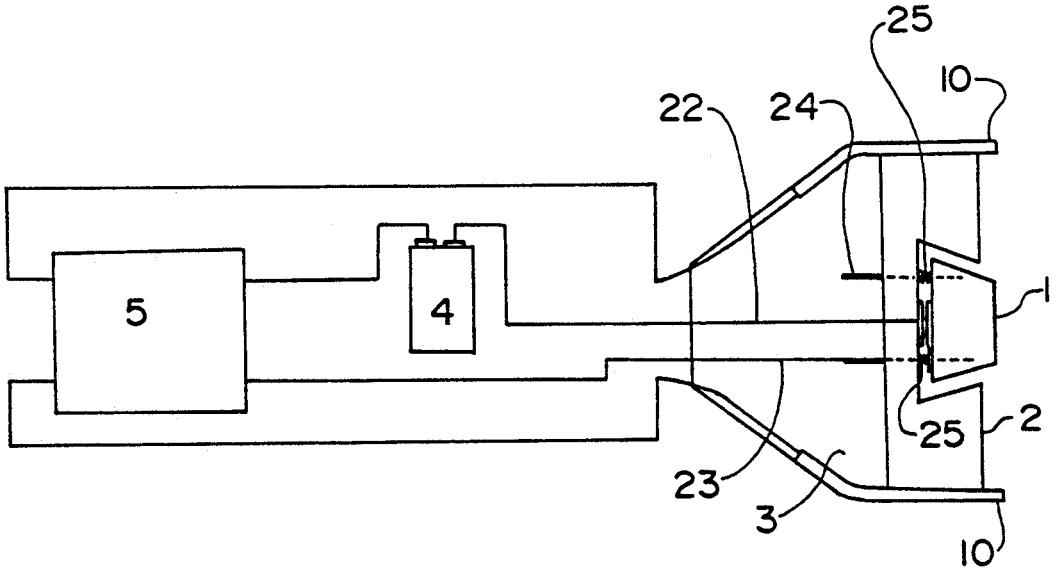
FIG. 2 shows system with power pack
Figure 3:
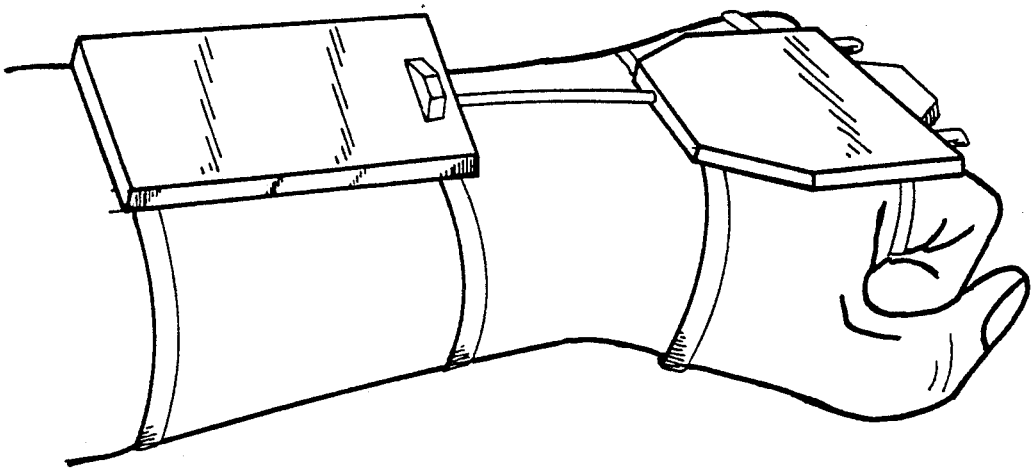
FIG. 3 shows on/off switch.

FIG. 1 shows the internal workings of the shocking unit, the actual unit will have an upper and lower housing to contain the working elements, (the upper housing is not shown in FIG. 1). The unit is designed to be attached to the top of one's fist near the knuckles and there is a strap or other attaching means connected to the housing to facilitate this. The housing portions should be joined by screws, etc. and sealed with an epoxy or other sealing means.

The working elements inside the housing essentially comprise the central portion 2 and the contacting portion 1 which is resiliently held away from the central portion where it can be urged against the central portion by making contact with an attacker.

At least two electrical contact points 20, 21 are used, One in connection with the central portion and the other in connection with the contacting portion. These two contacts are in connection with leads 22 and 23 that complete a circuit with the battery 4 and converter 5 when the contacts touch. Note that lead 23 is in connection with contact 21, the contact point on the contacting portion 1.

The two portions 1 and 2 are not in contact initially as they are held apart by the biasing means (usually springs) in connection with the guide pins 24 and 23. Note that guide pin 23 also acts as one of the leads. 22 is the other lead. The two contact points 20 and 21 are not in electrical connection at rest. The electrical circuit formed by the battery 4, power converter 5 and the shock probes 10 is not completed until the contacting points are in connection.

When the contacting portion makes contact with a portion of the attacker, the contact point 21 makes contact with the contact point 20 on the central portion and an electrical connection is established through the circuit. The power converter steps up the voltage and energizes the shock probes 10 and they deliver a shock.

When in the normal, at rest, mode the front portion of the contacting portion of the shocking unit will overhang the knuckles of the fist slightly so that it protrudes from the closed fist. Thus, the contacting portion will easily make contact with an attacker when a punch is delivered. At that point, the electrical contact on the contacting portion joins that on the central portion and the device is activated (shock given).

The shock probes 10 are located on the outside edges of the central portion and extend forward from the front edge of the device so that they are in position to deliver a shock. Each of the shock probes is in electrical connection with the power converter 5 which steps up the voltage from the battery 4 when the circuit is completed.

Guide rods 24 and 23 are secured in the contacting portion 1 and are held in apertures in the central portion. The guide rods allow the contacting portion to slide back and forth so that the contacting portion will come in contact with the central portion when it is pushed all the way back by the contact of the fist. The guide rods should be rigidly secured in the contacting portion and are held in apertures in the contacting portion so that the guide rods allow the contact portion to slide closer or farther from the central portion.

There would preferably be a resilient means 25 (preferably a spring) located in connection with the guide rods to ensure that the contacting portion will be held away from the central portion until the unit is actually used i.e. until the contacting portion actually comes in contact with the attacker.

To facilitate the operation of the contacting portion, a portion of the central portion may be removed with a shape that corresponds to the shape of the contacting portion. In a sense, the contacting portion "fits" within an aperture of the central portion.

When the contacting portion makes contact with an attacker, the contacting portion is pushed back against the central portion and the contact point on the contacting portion makes contact with the contact point on the central portion and the electrical connection is completed. With the circuit energized, the converter steps up voltage from the battery and this charge is sent to the shock probes located on the outside edge of the central portion. This provides a shock that is sent to the attacker. Withdrawing the fist will result in deactivating the circuit, a feature that provides safety.

The shock probes would preferably protrude through the housing beyond the knuckles so that they will be in good position to deliver the shock once the device is activated. Other configurations are also possible.

A powering unit for the shock probes may be attached to the belt or forearm of the wearer. For ease of wearability, the power unit should be built small, probably about the thickness of a nine volt battery (approx. ⅝"). Alternately, both the shocking unit and the attached powering unit could both be mounted on a glove for easy application and removal from the arm. Insulation may be used in the fingers of the glove. Separate activation switch may be located on the powering unit.

Figure 4:
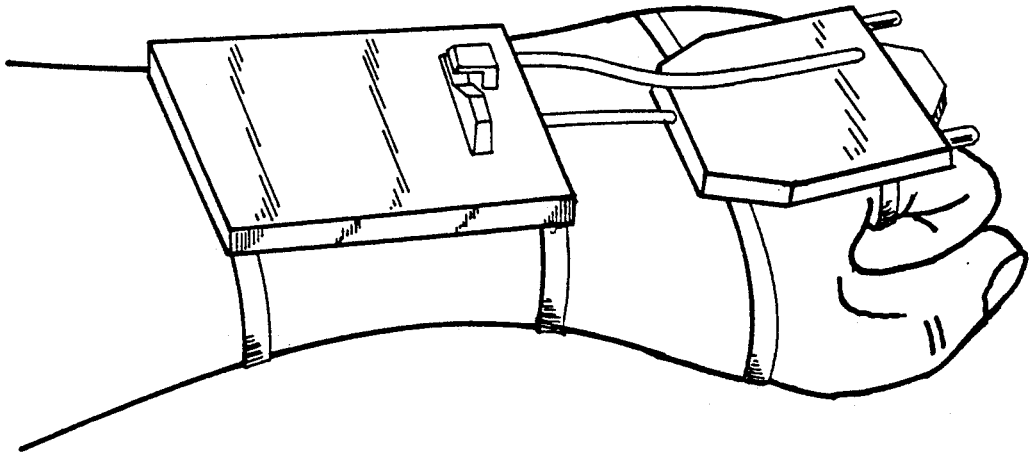
FIG. 4 shows optional mace dispensing system
FIG. 5 side view of mace dispensing system
FIG. 6 Control switch for mace system.

A mace dispensing device (see FIGS. 4–6) may also be used in conjunction with the unit. The mace device would preferably have outlet means near the shock probes for delivering a spray at the same time as the shock is delivered. A mace supply could be located on the belt or forearm and would have a separate activation switch.

I claim:

1. A shocking device for attachment to the wrist of a user comprising: a strap having means for attachment around said wrist, a body portion in connection with said strap and having a front face so as to define a plane and left and right side edges, an extended portion in connection with a guide means, said guide means perpendicular to said plane and in connection with said front face, said guide means for extending said extended portion from said front face and for guiding said extended portion against said front face, a contact means on said extended portion and a second contact means on said face, a source of electric power connected to said contact points by a conducting member so as to effect an electrical current through said conducting member when said contact points contact one another, shock probes in connection with said left and right side edges and extending from said front face in the same direction as said extended portion, said shock probe in connection with said conducting member so as to deliver an electrical current through said shock probes when said contact points contact one another.

2. The apparatus of claim 1 having a biasing means in connection with said front face and said extended portion, said biasing means for urging said front face and said extended portion apart from one another.

3. The apparatus of claim 2 wherein said guide means comprises a pair of rods connected to said extended portion and in sliding connection with a pair of apertures in said front face.

* * * * *